US005190473A

United States Patent [19]

Mroczkowski et al.

[11] Patent Number: 5,190,473

[45] Date of Patent: Mar. 2, 1993

[54] MICROCOAXIAL CABLE CONNECTOR

[75] Inventors: Robert S. Mroczkowski, Lititz; Richard E. Rothenberger, Harrisburg, both of Pa.

[73] Assignee: AMP Incorporated, Harrisburg, Pa.

[21] Appl. No.: 884,790

[22] Filed: May 18, 1992

[51] Int. Cl.[5] ..... H01R 13/00

[52] U.S. Cl. ..... 439/580; 439/610

[58] Field of Search ..... 439/578-585, 439/607, 608, 610

[56] References Cited

U.S. PATENT DOCUMENTS

| | | | |
|---|---|---|---|
| 4,186,982 | 2/1980 | Cobaugh et al. | 339/17 |
| 4,236,779 | 12/1980 | Tang | 439/580 |
| 4,256,945 | 3/1981 | Carter et al. | 219/10.75 |
| 4,596,432 | 6/1986 | Tighe et al. | 439/580 |
| 4,626,767 | 12/1986 | Clappier et al. | 323/280 |
| 4,659,912 | 4/1987 | Derbyshire | 219/535 |
| 4,789,767 | 12/1988 | Doljack | 219/9.5 |
| 4,852,252 | 8/1989 | Ayer | 29/860 |
| 4,871,319 | 10/1989 | Babow | 439/77 |
| 4,927,369 | 5/1990 | Grabbe et al. | 439/66 |
| 5,009,616 | 4/1991 | Fogg et al. | 439/608 |
| 5,052,949 | 10/1991 | Lopata et al. | 439/610 |
| 5,061,827 | 10/1991 | Grabbe | 174/756 |
| 5,090,116 | 2/1992 | Henschen et al. | 29/827 |

*Primary Examiner*—Joseph H. McGlynn
*Attorney, Agent, or Firm*—Anton P. Ness

[57] ABSTRACT

A connector assembly (100) for an array of discrete microcoaxial wires (10) includes a housing (102) with signal terminals (140) disposed therein having intermediate sections (154) exposed along a rearward housing section (114) for eventual solder termination to inner conductor ends (20) of the wires. The signal terminals of each row are initially joined to a respective carrier strip (146) until after soldering. A ground plate (50) is insertable into a medial slot (106) of the housing and includes an array of semicylindrical nests (56) formed to receive portions of the microcoaxial wires thereinto for soldering of ground ferrules (30) therearound directly to the nests (56) prior to insertion of the ground plate into the housing, thereby defining a wire-carrying subassembly (90). When the ground plate (50) is inserted into the housing (102), the stripped inner conductors (20) are positioned at termination sites (144) of the signal terminals (140) for soldering.

22 Claims, 12 Drawing Sheets

MICROCOAXIAL CABLE CONNECTOR

FIELD OF THE INVENTION

This relates to the field of electrical connectors and more particularly to electrical connectors for coaxial cable.

BACKGROUND OF THE INVENTION

For many years coaxial cable has been the transmission medium of choice for high-speed electronic applications. The controlled impedance, low crosstalk and EMI/RFI o (electromagnetic interference/radiofrequency interference) shielding offered by coaxial cable are the driving forces for its selection for such applications. The sophistication and speed of electronic instrumentation and equipment has increased significantly in recent years due to the rapid advances in the capabilities of microprocessor technology in both speed and density. Connectors and interconnections for such equipment, and in particular, for coaxial cable, have seen similar increases in pin count and density requirements.

In the high-speed electronic applications requiring coaxial cable the interconnection scheme must maintain acceptable levels of signal integrity, particularly with respect to crosstalk, shielding and controlled impedance. Providing this performance requires that the connector introduces minimal effects on the consistency of the impedance and shielding of the cable through the connector and across the separable interface. One approach to meeting this requirement at increased connector density is to use microcoaxial cable, with center conductors of 40 AWG and smaller. Processing coaxial cable elements with outside diameters of less than 0.5 mm, and center conductors of 0.075 mm, and smaller, present design and manufacturing challenges.

To facilitate cable preparation a microferrule process has been developed and is disclosed in U.S. Pat. No. 5,061,827. A thin copper foil is applied around the outside of the cable, exposing the shield wires along the axis of the foil by laser ablation, and soldering the shield wires directly to the foil. The copper foil strip is sheared and formed to suitable dimensions to define, in one embodiment, axially extending barbed edges which when the foil is disposed around the cable will oppose each other and will extend radially inwardly to penetrate the outer insulation of the coaxial elements and engage the shield wires. The partially formed microferrule is transferred into a nest which is transferred beneath and in axial alignment with the coaxial element, after which the microferrule is crimped onto the coaxial element. Upon crimping the microferrule defines an open seam between the radial locations of insulation penetration by the barbed edges, exposing the cable insulation for ablation to expose the shield wires to be soldered to the microferrule through reflow soldering using solder paste deposited thereat, all using a $CO_2$ laser system, RF modulated 25 watt, sealed, in conjunction with a PC-based TTL pulse generator to attain the extremely different pulse definitions for the two tasks. Thereafter the insulation forwardly of the crimp area is stripped through conventional mechanical or laser methods, to expose the inner dielectric and center conductor for termination.

It is desired to provide a connector capable of accepting sixteen coaxial elements in a microstrip configuration, where the modular connector serves as an electrical bridge between the coaxial elements and a printed wiring board. U.S. Pat. No. 4,927,369 discloses an interposer connection assembly for interconnecting such a modular connector having a printed circuit element mounted to the mating face, to a printed wiring board.

It is additionally desired that such connector accommodate a plurality of microcoaxial elements in a very closely spaced, or high density, configuration for both the signal and ground conductors thereof.

It is also desired that such a high density connector be easily applied in a simplified procedure, with automatic controlled soldering of the signal conductors to respective contacts when in the connector housing.

SUMMARY OF THE INVENTION

A modular microcoaxial connector is adapted for termination to discrete microcoaxial conductors of a multiwire shielded cable and includes an array of discrete signal terminals disposed in respective passageways of a dielectric housing, with contact sections at least exposed across the mating face for electrical connection to another electrical article. The ground or outer conductors of the plurality of wires are electrically connected to a common ground plate axially rearward of the signal terminal array, with one or more ground contact sections of the ground plate extending forwardly through respective passageways of the housing to be similarly exposed across the connector mating face.

Each microcoaxial wire in a preferred arrangement includes a ferrule crimped about the end of the insulated portion of the wire end and includes opposed axially oriented barbed edges penetrating the outer insulation and engaging the ground shield wire or outer conductor therewithin, while defining an open axial seam therebetween for laser ablation of the insulation to expose the shield wire for depositing of solder paste and soldering to the ferrule along the seam. The ground plate extends rearwardly to a trailing edge and includes an array of semicylindrical ferrule-receiving nests stamped from the plate and formed out of the plane of the plate for receipt thereinto of respective ones of the ferrules terminated to the wires' outer conductors. For a two row connector the ground plate is disposed between the wire rows and includes two rows of such nests formed outwardly in opposing directions to receive the ferrules of the two rows of wires along opposing sides of the ground plate, with the nests for one row axially staggered from those for the other row. The ferrules are then soldered within the respective nests. Once the ferrules are soldered to the ground plate, the conductor ends are mechanically secured to the ground plate which is then manipulatable as a unit for the forward section including one or more contact sections to be inserted into and secured in a median slot of the housing between the two rows of signal terminals, with the contact sections disposed in discrete passageways between the signal terminal contact sections; the ground plate thus serves as a wire-carrying device during assembly.

Preferably solder paste may be previously disposed along the inside surfaces of the nests. The ground plate may also include along its rearward edge a transverse frangible section having a bimetallic layered arrangement of nonmagnetic low resistance metal/magnetic high resistance metal to define a self-regulating temperature source when subjected briefly to radiofrequency constant amplitude current induced therein utilizing Curie point heating to reflow the solder; after soldering the frangible section can be removed.

Initially the signal terminals are stamped and formed from a common strip and remain integrally joined at their rearward ends to a carrier strip to facilitate handling during connector assembly, with two such terminal strips defining two rows of signal terminals for each connector. Each signal terminal includes a contact section extending forwardly to be inserted through a respective passageway of the housing and then extending forwardly thereof exposed for eventual mating with another electrical article during in-service use, such as insertion into a through-hole of a printed circuit board. Once inserted, a locking lance of each terminal retains the terminal within the passageway cooperating with a forwardly facing ledge of the housing along the passageway sidewall, and is optionally assisted by an interference fit of the terminals in the passageways. Spaced a selected distance rearwardly of the passageway entrance, the signal terminals include intermediate sections disposed along respective channels formed along a rearward section of the housing to acutely angled bends and then rear sections extend laterally outwardly to join them to the carrier strip. The carrier strip preferably defines a self-regulating Curie point heater, having a nonmagnetic low resistance metal/magnetic high resistance layered structure, which when subjected to appropriate RF current will generate heat to melt solder at the termination sites of the signal terminals with respective inner conductors of the wires, after which the carrier strips are removed.

The stripped inner conductors extend forwardly of the edge of the insulation axially spaced forwardly of the ferrule crimped and soldered to each wire, to be received into rear entrances of the channels of the rearward housing section. Tapered surfaces of the channel bottoms deflect the conductor ends slightly outwardly, either upwardly or downwardly at a modest angle, whereafter the conductor ends enter the termination sites of respective signal terminals which are adapted to facilitate wire entry without stubbing. The conductor ends are then soldered to the respective signal terminals, with solder paste applied to the termination site along the wire end, and the assembly placed within the coils of an RF generating apparatus for RF current to be induced briefly in the carrier strips to generate thermal energy for reflowing the solder. After assembly and soldering, an insulative covering is optionally molded over the exposed terminal portions and conductor ends and ground plate and a portion of the cable insulation.

In one embodiment, the termination site of each signal terminal includes a centered wire-receiving groove extending axially forwardly from an aperture at and outwardly of the bend along the rear terminal section, the groove extending into the outwardly facing surface of the terminal. Wire-engaging edges of both the groove and the aperture are chamfered to facilitate receipt of the respective conductor end. The termination site along the outwardly facing surface of the signal terminal thus permits visual inspectability after soldering unobstructed by connector structure, if desired. The aperture at the bend defines an inherently frangible section thereat facilitating breaking off of the carrier strip after soldering.

In another embodiment, the termination site of each signal terminal comprises an inwardly facing surface at the bend, within a recessed portion of the channel of the rearward housing section, with the width of the terminal reduced through the bend and the rear terminal section for flexibility, and the rear terminal section is joined to the carrier strip at a frangible section to facilitate carrier strip breakoff. The lead frame is so formed that after insertion into the housing the reduced width terminal section is slightly spring biased against the bottom surface of the recessed channel portion. A respective conductor end is received into the recessed channel portion between the channel bottom and the inwardly facing terminal surface; the signal terminals are slightly deflected outwardly en masse by prying of both the carrier strips slightly away from each other thus flexing outwardly the reduced width terminal sections at the respective bends until the stripped inner conductor ends are positioned thereunder, and solder paste is applied. The conductor end then becomes slightly compressed by the reduced width terminal section which facilitates the soldering operation.

It is an objective of the present invention to provide a high density connector for discrete microcoaxial wires such as of a round cable, with impedance matching characteristics.

It is also an objective to provide a system for mechanically connecting the conductors to the connector structure in a manner protecting the signal terminations from stress, by soldering ferrules grounding the wire shield of respective conductors to the ground plate within integral nests thereof, and simultaneously defining a ground plate/wire subassembly serving as a wire carrier to simplify wire handling during connector assembly.

It is an additional objective to provide for automated soldering of the ferrules providing ground connections of the outer conductors of the discrete wires to a ground plate, by use of a frangible rearward section of the ground plate defining a Curie point heater which is then removable after ferrule soldering.

It is similarly an additional objective to provide for automated soldering of the inner conductors to respective signal terminals of the connector, using Curie point heaters, while also providing for simplified terminal assembly procedures, both through the use of a frangible carrier strip for the respective rows of signal terminals.

Embodiments of the present invention will now be described by way of example with reference to the accompanying drawings.

BRIEF DESCRIPTION OF THE DRAWINGS

FIG. 13 is an isometric view of a second embodiment of the present invention, utilizing the ground plate/wire-carrying subassembly of FIG. 8 and a second embodiment of signal terminal;

DETAILED DESCRIPTION OF THE PREFERRED EMBODIMENTS

Figure 1:
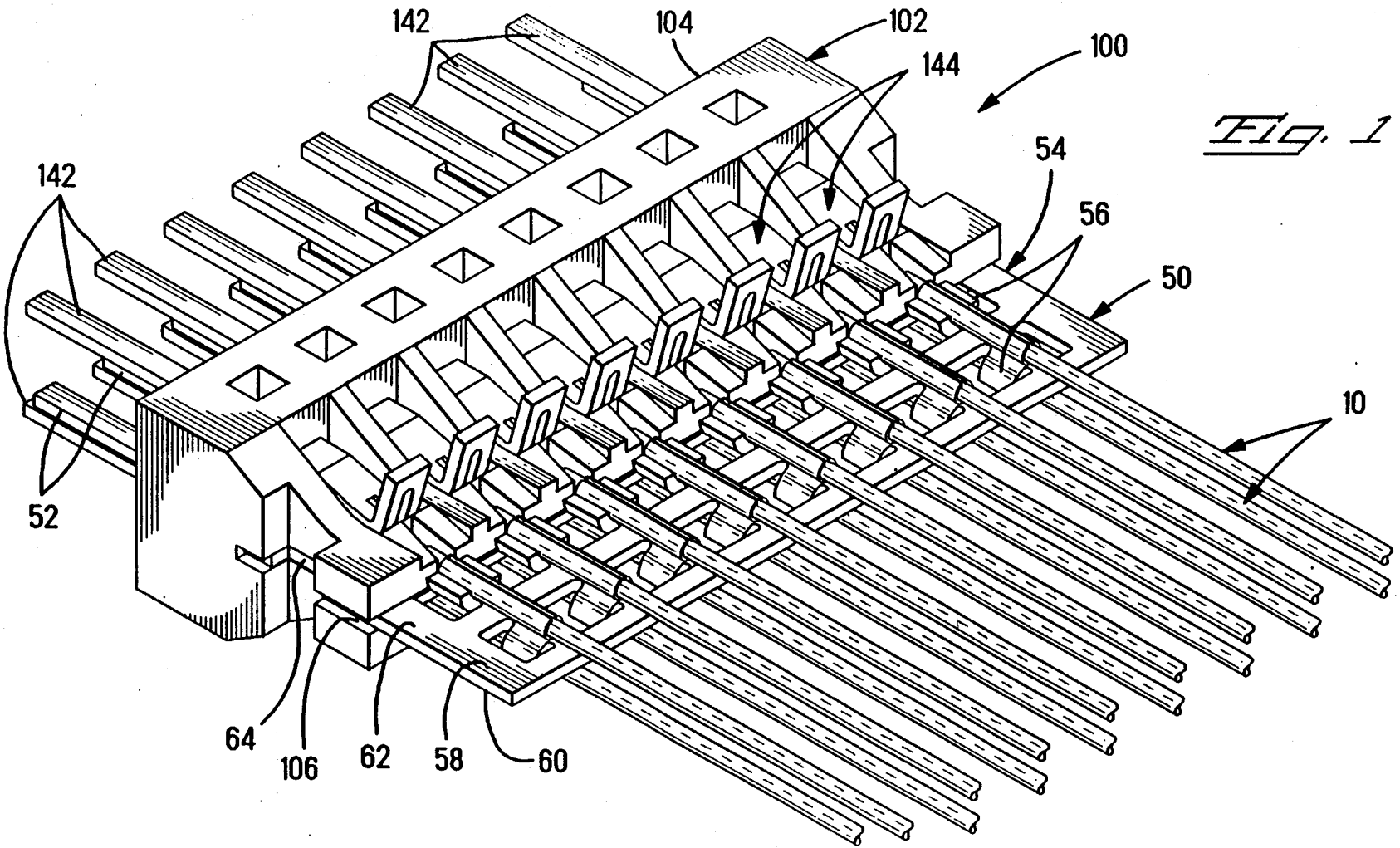
FIG. 1 is an isometric view of the microcoaxial connector of the present invention prior to forming an insulative covering thereover, illustrating the plurality of discrete microcoaxial wires having inner and outer conductors terminated to signal terminals of a first embodiment and a ground plate respectively.
Figure 2:
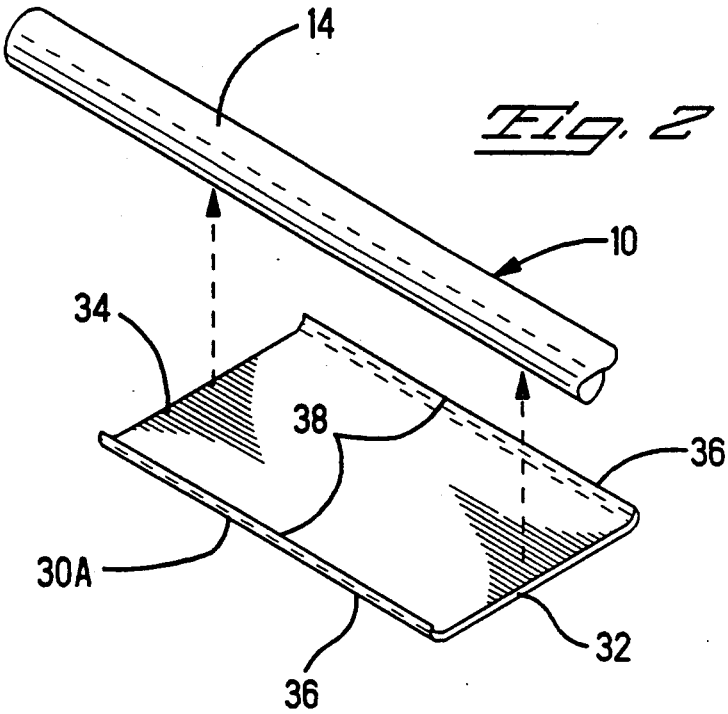
FIGS. 2 to 5 show termination of a ferrule to an insulated portion of a respective discrete microcoaxial wire, with FIGS. 2 and 3 showing placement of the ferrule on a wire end and FIGS. 4 and 5 showing a cross-section of the ferrule termination before ablation of the outer insulation and after soldering, respectively.
Figure 3:
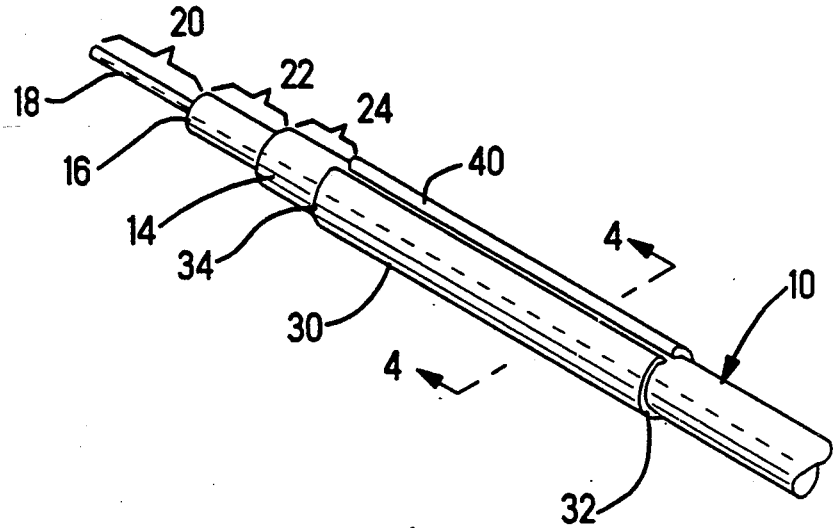

FIGS. 1 to 12 are directed to a microcoaxial connector assembly 100 utilizing a signal terminal of a first embodiment, while FIGS. 13 to 17 are directed to an assembly 200 of a second signal terminal embodiment. FIGS. 2 to 5 are directed to application of ferrules 30 to each microcoaxial wire 10 in a manner which establishes an assured electrical connection with the shield wire 12 which defines the outer conductor of each wire 10 and is commonly termed a served shield. Both embodiments utilize the ground plate 50 of FIG. 6 to which ferrules 30 secured to respective microcoaxial wires 10 are mechanically secured, thus defining a wire carrier 90 useful during assembly.

Microcoaxial connector assembly 100 of FIG. 1 includes a housing 102 within which are secured two rows of signal terminals 140 having contact sections 142 extending forwardly of housing 102 for electrical connection with another electrical article (not shown) such as a printed circuit board. Ground plate 50 includes an array of ground contact sections 52 extending forwardly of mating face 104 of housing 102 between the two rows of signal terminal contact sections 142, providing impedance matching benefits at the mating interface. The microcoaxial wires 10 are arrayed in two rows, upper and lower, and include inner conductors of wires 10 electrically connected to respective signal terminals 140 at termination sites 144. Outer conductors of wires 10 are electrically connected by ferrules 30 to respective semicylindrical nests 56 of ground plate 50 at termination region 54 formed on respective upper and lower surfaces 58,60 on rear plate portion 62 extending rearwardly of housing 102. Ground plate 50 includes a forward plate portion 64 disposed within a medial slot 106 of housing 102.

Figure 4:
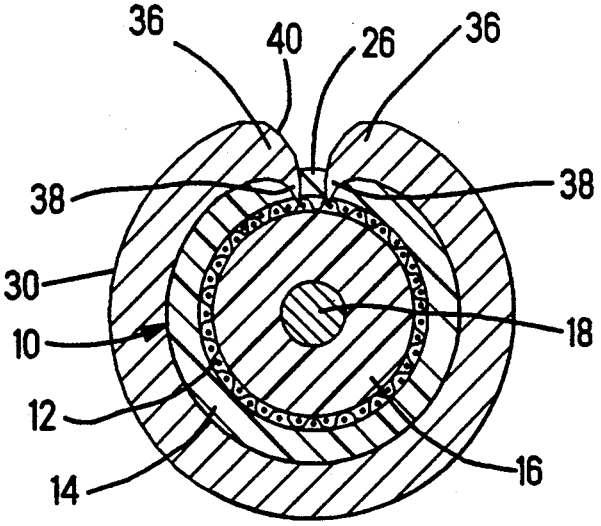

FIGS. 2 to 5 illustrate the preparation of the end of a microcoaxial cable 10 and the application of a ferrule 30 thereonto, in a preferred procedure as disclosed in U.S. Pat. No. 5,061,827. The structure of a wire 10 is best seen in FIG. 4, and includes a served shield outer conductor 12 surrounded by the outer insulative jacket 14 and overlying an inner insulative layer 16 within which is centered an inner conductor 18. A copper foil 30A is stamped having a rearward end 32, forward end 34 and axially extending edges 36, and is formed so that edges 36 coextend to barbs 38. The copper foil 30A is wrapped around an end portion of the wire and crimped thereto to form a ferrule 30 therearound, with a portion of the wire covered by the outer jacket 14 extending forwardly of forward ferrule end 34. The barbs are urged radially inwardly to penetrate the outer insulation to engage the served shield, and axial edges 36 are now opposed and spaced to define a gap 40 therebetween. Portions of the outer jacket and served shield are severed and removed from an end portion of wire 10 and the inner insulative layer is removed from a lesser length end portion 20 defining an intermediate portion 22 having the inner insulative layer exposed. To simplify wire end preparation conventional tooling may be referenced easily to the forward end 34 of each ferrule 30, assuring that accurate lengths of portions 20 and 22 are attained and that a further jacketed portion 24 of selected length extends forwardly of each ferrule 30.

Figure 5:
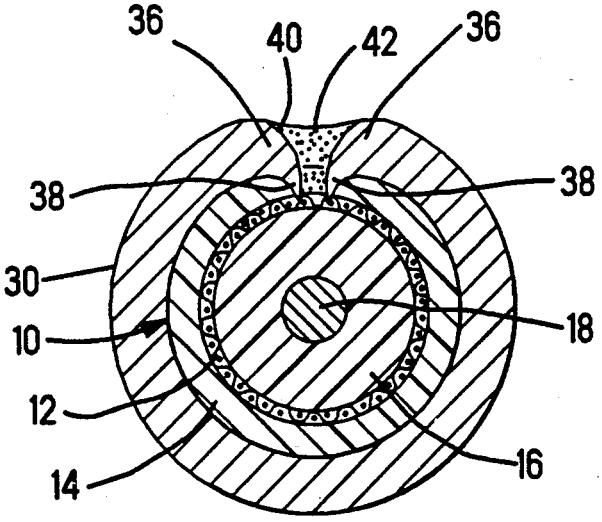

A portion 26 of outer jacket 14 is exposed between opposed edges 36, as shown in FIG. 4, which is removed by laser ablation. Thereafter solder 42 is placed along seam 40 against served shield 12 and against opposed edges 36 and is thereafter reflowed to form a soldered electrical ground connection between ferrule 30 and served shield outer conductor 12 of wire 10, as shown in FIG. 5. An alternate method of terminating to ground plate 50 is provided by soldering the served shields directly in respective nests without ferrules 30.

Figure 6:
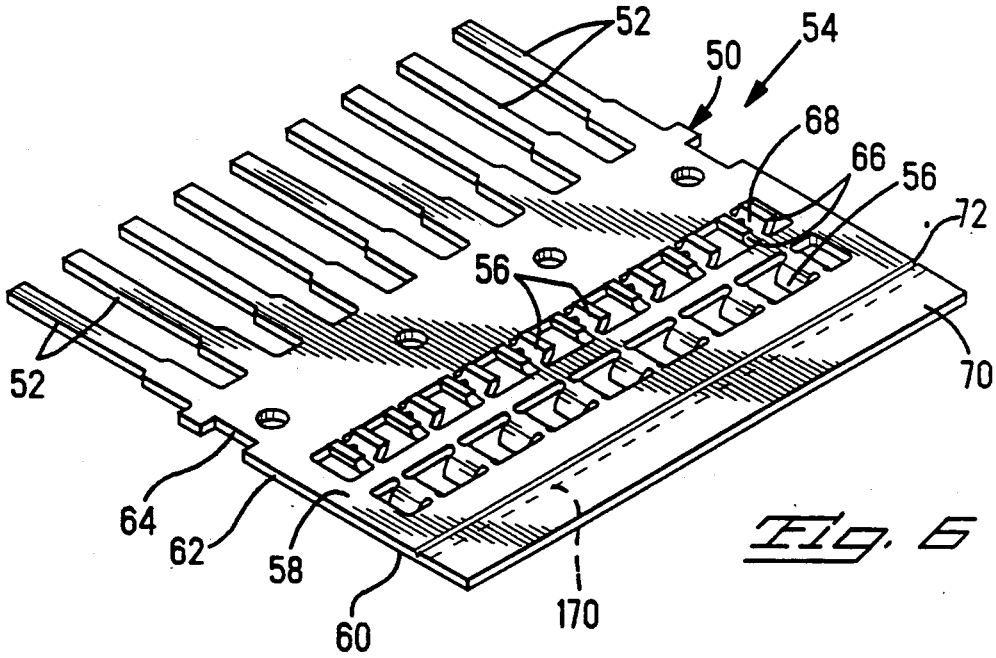
FIGS. 6 and 7 are isometric views of the ground plate and of a signal terminal strip and connector housing respectively.

Referring to FIG. 6, ground plate 50 is formed of a blank such as for example of Copper Alloy UNS C51100, phosphor bronze to have ground contact section 52 stamped therein; nests 56 are stamped in rearward portion 62 in two rows to have opposing sidewalls 66 which are subsequently formed outwardly of the upper surface 58 in one row and outwardly of lower surface 60 in the other row, into semicylindrical shapes approximately the shape and size of ferrules 30 applied to wires 10 thus defining suitable nests therefor. Ground plate 50 thus will serve as a wire organizer. Deposits 68 of solder paste are formed along the bottom of each nest 56 enabling soldering of ferrules 30 therewithin. A rearwardmost end section 70 of ground plate 50 is preferably joined to rearward portion 62 at a frangible section defined by groove 72. Preferably forwardly of groove 72 ground plate 50 is plated such as by tin-lead for solderability.

End section 70 preferably includes a Curie point heater formed by an incrementally thin layer of high resistance magnetic material intimately joined to at least one outer surface of the copper material of the ground plate. Self-regulating temperature sources are known such as from U.S. Pat. Nos. 4,852,252; 4,256,945 and 4,659,912. End section 70 thus has a first layer of low resistance low magnetic permeability metal such as the copper alloy of the ground plate, and a second layer formed on a surface thereof such as by roll cladding or bonding and comprising at least one skin depth of a metal having high magnetic permeability and high electrical resistance. For example, the magnetic layer may be of nickel-iron alloy such as Alloy 42 (42 percent nickel, 58 percent iron) clad onto ground plate 50 having a thickness of about 0.0007 to 0.0010 inches.

Figure 7:
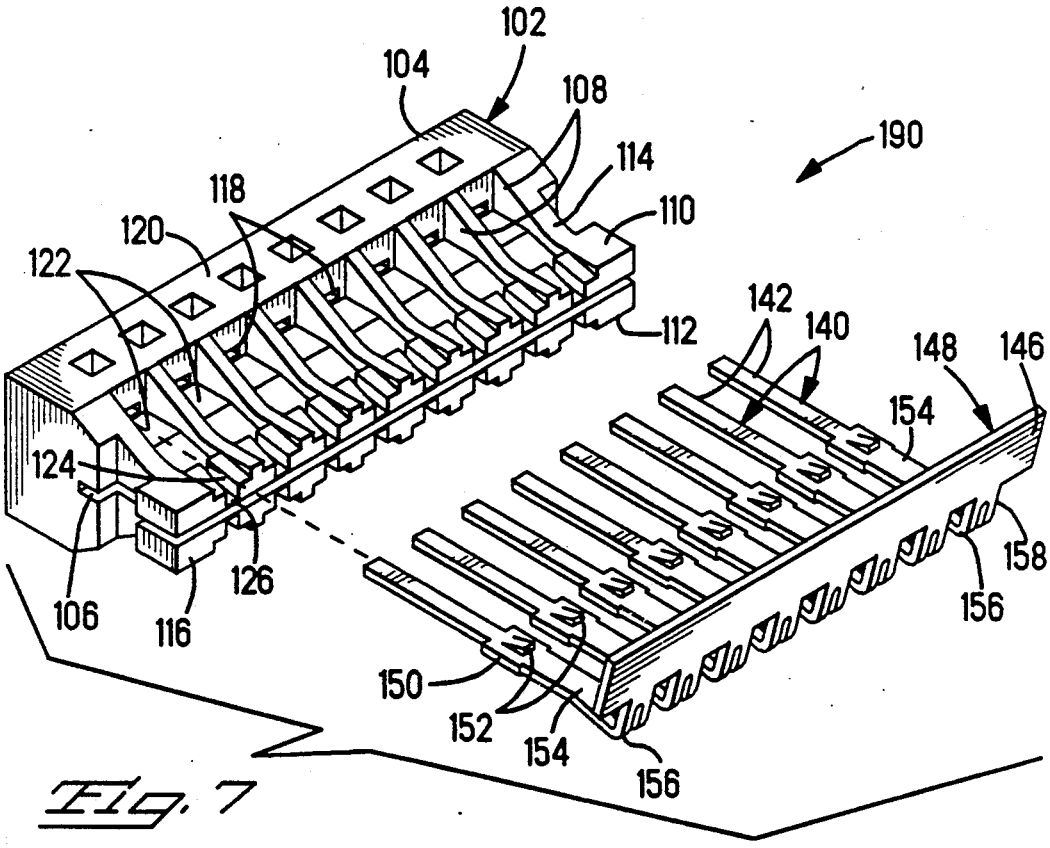

In FIG. 7 housing 102 is shown to have an array of channels 108 along top and bottom surfaces 110,112 of rearward section 114, extending rearwardly to rearward end 116 from entrances of passageways 118 extending forwardly through forward housing section 120 to mating face 104. Bottom surfaces 122 of channels 108 are tapered toward the central plane of housing 102 extending through medial slot 106 to narrowed channel portions 124 extending to wire-receiving channel entrances 126 at rearward end 116.

Signal terminals 140 comprise two rows in the disclosed embodiment and are initially joined to a carrier strip 146 to form a lead frame 148 which facilitates handling during assembly. Body sections 150 are wider than contact sections 142 and are disposed within forward housing section 120 after insertion of contact sections 142 through passageways 118. Locking lances 152 are preferably formed in body sections 150 to extend rearwardly and relatively outwardly to free ends to assist retention in passageways 118. Rearward sections 154 extend rearwardly from body sections 150 to bends 156 and end sections 158 continue on to join the signal terminals to carrier strip 146. Lead frames 148 are assembled to housing 102 by insertion of contact sections 142 into the entrances of respective passageways 118, with widened body sections 150 preferably fitting snugly thereinto in a modest force fit, to define a connector subassembly 190. Bends 156 are disposed just forwardly of narrowed rearward channel portions 124 of housing 102.

Figure 8:
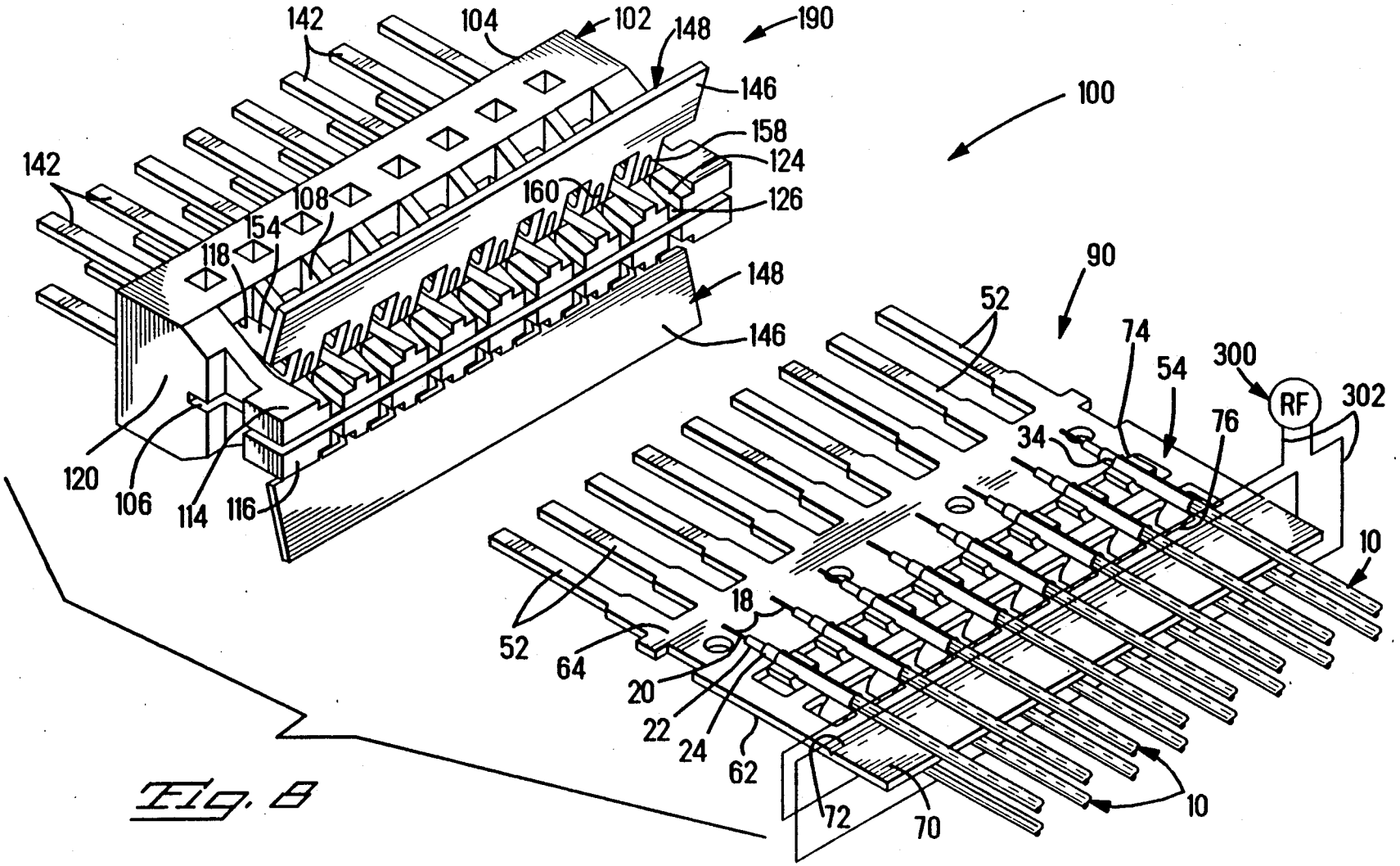
FIGS. 8 and 9 are isometric views of the wires secured and grounded to the ground plate of FIG. 6 to define a wire-carrying subassembly about to be assembled to the connector housing having a pair of signal terminal strips of FIG. 7 secured in opposing sides thereof, and fully assembled thereto respectively, with FIG. 8 including a representative RF generator and coil therearound for Curie point heater soldering.

Referring to FIG. 8, connector subassembly 190 is ready to receive ground plate/wire subassembly or wire carrier 90 thereinto. Wire carrier 90 is formed by soldering ferrules 30 within nests 56, once the ferrules are properly located axially along the nests. Reference is easily made by aligning forward ends 34 of ferrules 30 of the upper row with the forward ends 74 of the nests 56 along upper surface 58 of ground plate 50, and rearward ends 32 of ferrules 30 of the lower row with rearward ends 76 of the nests along lower surface 60. Such referenced positioning assures that stripped inner conductor portion 20 extends forwardly to termination sites 144 of respective signal terminals 140, that insulated portion 22 protects the inner conductor rearwardly of its respective termination site 144, and jacketed portion 24 extends forwardly of nests 56 in ground termination region 54 and forwardly of rearward end 116 of housing 102 when wire carrier 90 is assembled to connector subassembly 190.

As illustrated in FIG. 8, for soldering ferrules 30 within and to respective nests 56, the Curie point heater defined by end section 70 of ground plate 50 is activated by induction of radiofrequency current in end section 70 by an apparatus 300 including a coil 302 surrounding the end section. Sources of appropriate current are disclosed in U.S. Pat. Nos. 4,626,767 and 4,789,767 which generate radio frequency current of 13.56 megaHertz. The selected Curie point temperature may be for example about 240° C., and the solder may be selected to have a reflow temperature of about 183° C.; the solder of deposits 68 may be for example Sn 63 tin-lead. Activation of the Curie point heater results in end section rising to a maximum temperature of about 240° C. and the thermal energy is conducted to nests 56 to reflow the solder. Localized heating of end section 70 and nests 56 for several seconds needed to reflow the solder has the important benefits of the controlled maximum temperature in a highly localized area for a very brief time, minimizing any adverse effect of heat on the wire insulation and the solder joint, for example.

Wire carrier 90 is moved axially forwardly for ground contact sections to enter medial slot 106 of housing 102 and into respective passageways (not shown) extending forwardly to mating face 104, and forward plate portion 64 enters slot 106. Stripped inner conductor portions 20 enter channel entrances 126 and bear against slightly tapered channel bottom surfaces which deflects the wire ends outwardly to move farther along narrow channel portions 124. Movement continues until forward nest edges 74 of ground plate 50 coincident with forward ferrule ends 34 abut rearward housing end 116.

Figure 10:
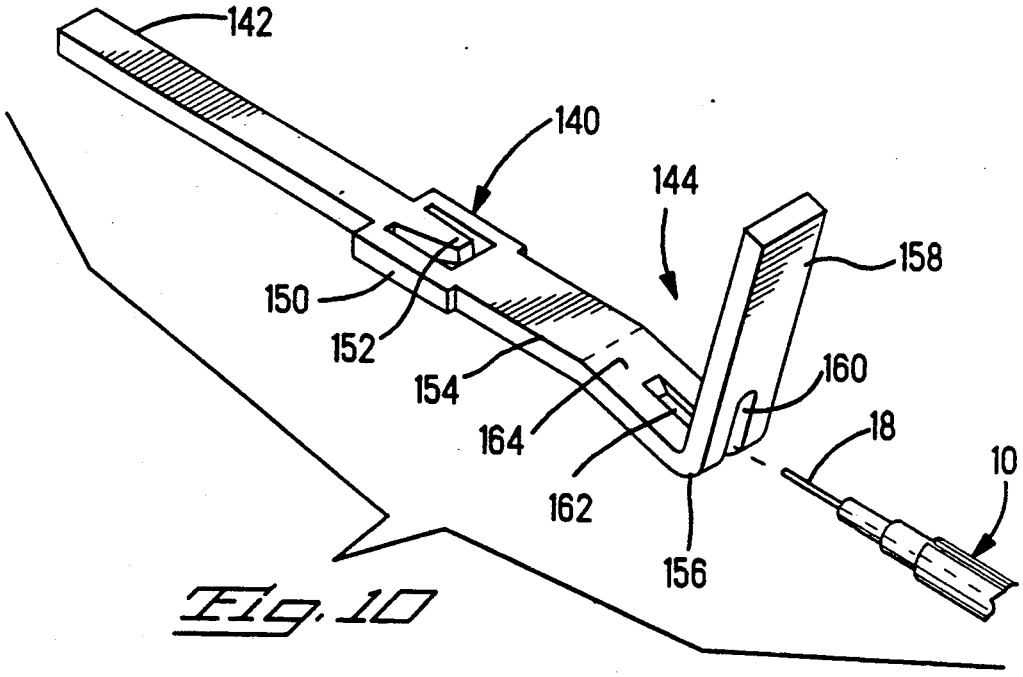
FIG. 10 is a representative isometric view of an inner conductor end being inserted into a wire-receiving groove of a signal terminal of the embodiment of FIGS. 1 to 9.
Figure 12:
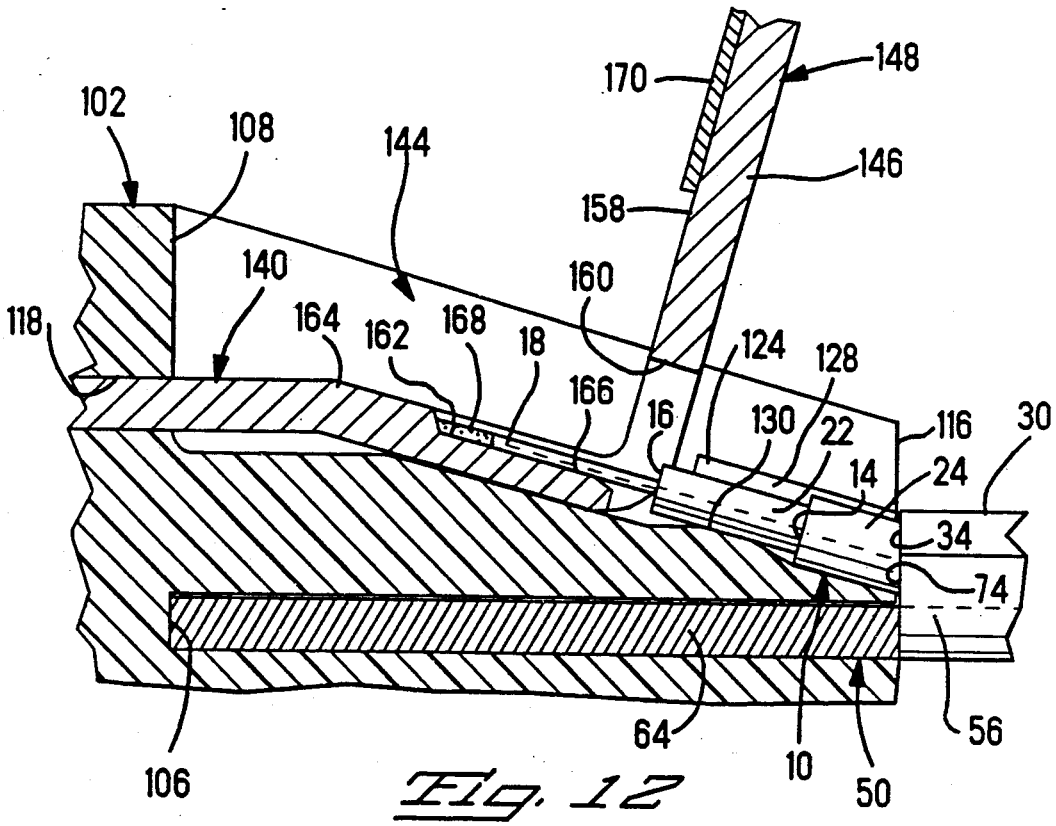
FIGS. 11 and 12 are longitudinal section and enlarged section views of the connector of FIGS. 1 to 10 showing upper and lower rows of inner conductor/signal terminal terminations and a central ground plate to which outer conductors of the wires are electrically connected rearwardly of the housing, with FIG. 11 including a representative RF generator and coil therearound for Curie point heater soldering and with FIG. 12 showing a termination site of an inner conductor to a signal terminal and a portion of the magnetic layer of the carrier strip.
Figure 11:
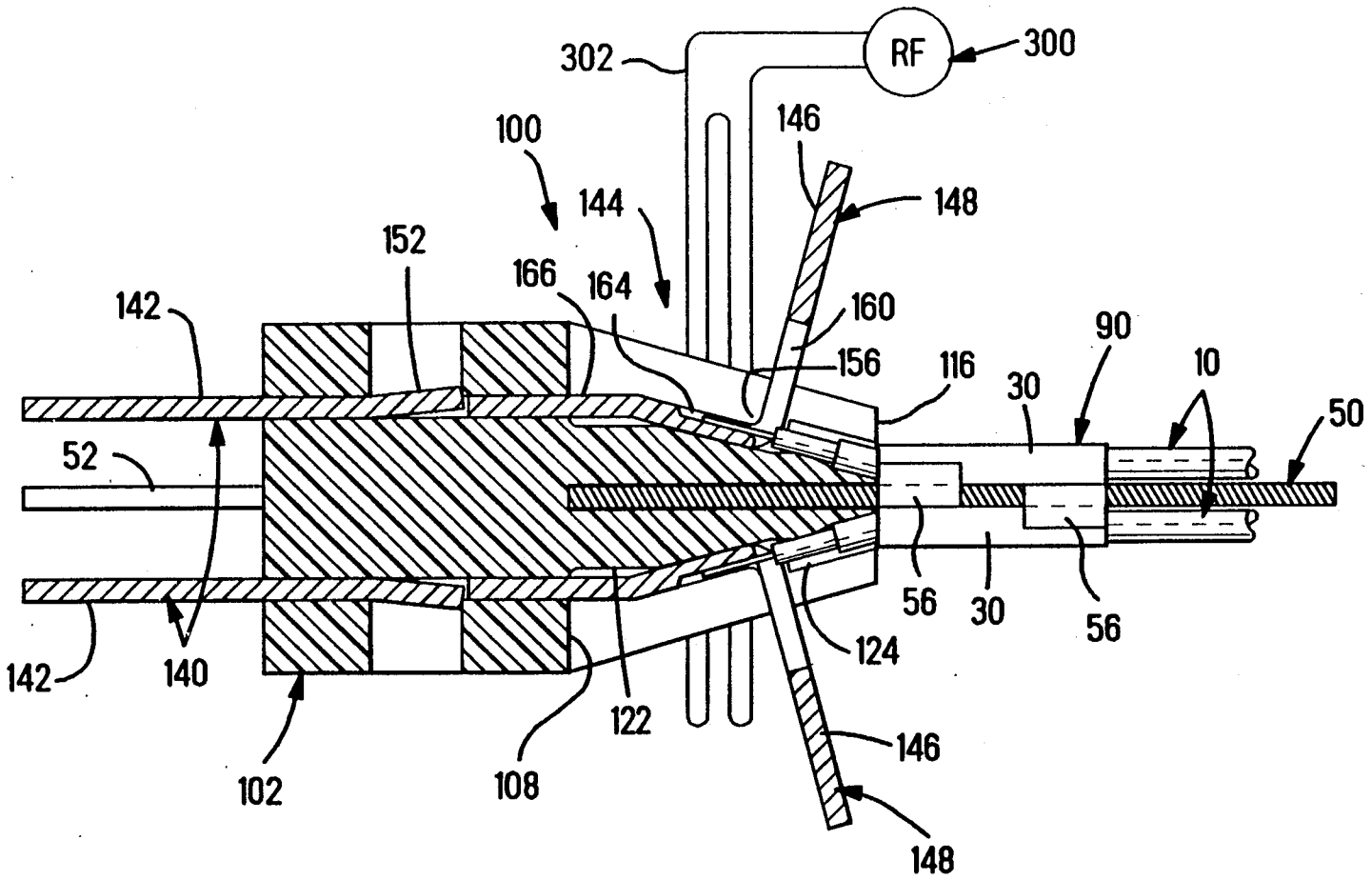

With reference to FIGS. 10 to 12, it may be seen how stripped inner conductor end 20 is received into its respective termination site 144. Each signal terminal 140 includes a wire-receiving aperture 160 at bend 156 and rearwardly along rearward section 158, into which inner conductor 18 is received. Just forwardly of bend 156, each signal terminal 140 includes a groove 162 coined into the outwardly facing surface 164 of the terminal, within which stripped inner conductor portion 20 will become disposed along groove bottom 166. Inner conductor end 20 is directed by converging side walls 128 of narrowed channel portion 124 to become centered with respect to groove 162 comprising termination site 144, and insulated portion 22 moving along the bottom 130 of narrowed channel portion 124 positions inner conductor portion 20 at a level just above groove bottom 166. Solder paste 168 is deposited in groove 162 along exposed inner conductor 18.

Lead frames 148 may be made from strips such as for example of Copper Alloy UNS C51100, phosphor bronze which is then tin-lead plated, excepting carrier strip 146. Carrier strip 146 preferably includes an incremental layer 170 of magnetic material such as Alloy 42 having a thickness of 0.0007 to 0.0010 inches, defining a Curie point heater. After wire carrier 90 has been assembled to connector subassembly 190, with stripped inner conductor ends 20 of microcoaxial wires 10 disposed in grooves 164, the assembly is placed within coils 302 of an RF apparatus 300 as disclosed hereinabove with reference to FIG. 7. Apparatus 300 induces a radiofrequency current of 13.56 megaHertz in the carrier strip, which rises to a selected maximum temperature generating thermal energy conducted along rearward terminal section 158 through bends 156 and into the termination site 144 in which groove 162 containing stripped inner conductor portion 20 and solder deposit 168 is located, reflowing the solder and forming a soldered termination of inner conductor 18 of microcoaxial cable 10 to signal terminal 140.

Figure 9:
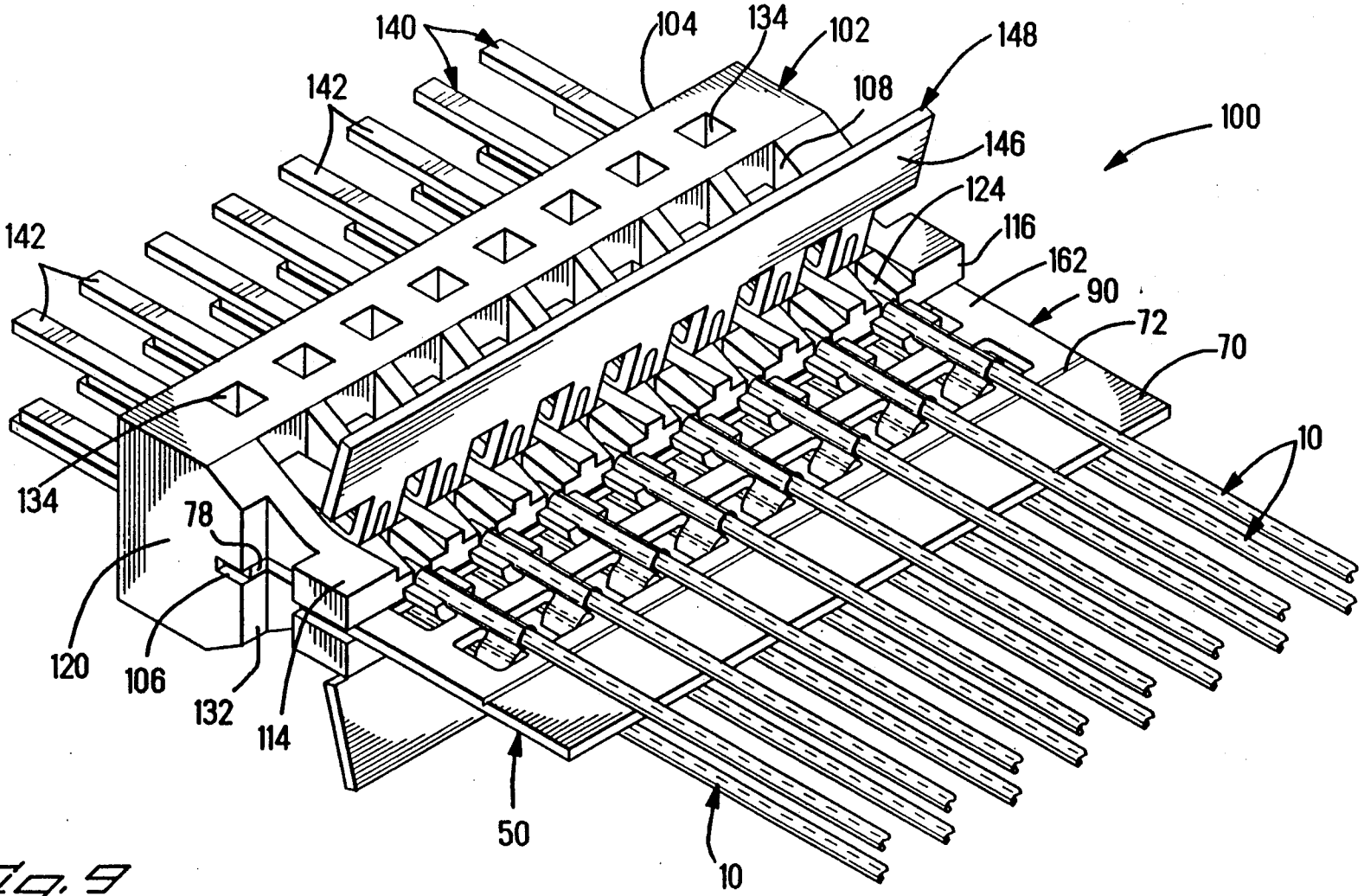

With reference to FIG. 9, side channels 132 and apertures 134 comprise tool-receiving recesses whereinto portions of tooling (not shown) are receivable during an optional later procedure for mounting a completed connector 100 to a printed circuit board, wherein signal and ground contact sections 142,52 include compliant spring sections (not shown) forcible into respective through-holes of the board under relatively high pressure; one type of such compliant spring formations are disclosed in U.S. Pat. No. 4,186,982. The tooling portions entering side channels 132 are engageable behind push surfaces 78 of ground plate 50, and tooling portions entering apertures 134 engage laterally against body sections 150 of each signal terminal 140, pressing them against passageway walls and thus against housing structure prior to application of axially forwardly applied pressure on the connector assembly.

Another embodiment of microcoaxial connector 200 is illustrated in FIGS. 13 to 16, wherein signal terminals 210 have different termination sites 212, and the structure of housing 202 and the assembly method of connector 200 is correspondingly different. A ground plate 50 and termination thereto of ferrules 30 crimped to the discrete microcoaxial wires 10 to define a wire-carrying subassembly 90, and insertion into a medial slot of housing 202 may be the same as with respect to the embodiment of connector 100 of FIGS. 1 to 12.

Figure 14:
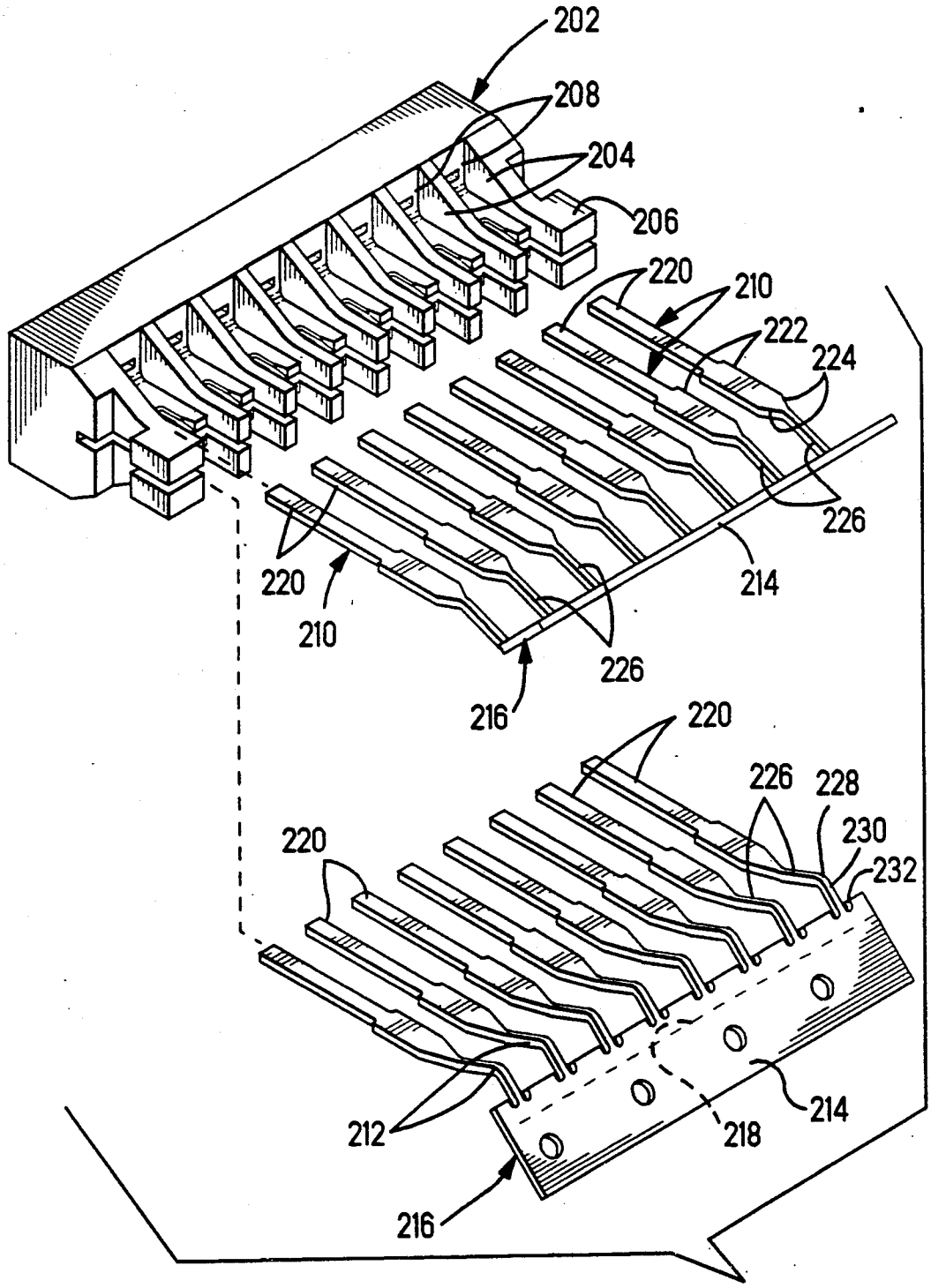
FIGS. 14 and 15 are isometric views of the connector of FIG. 13 showing the signal terminal strips being assembled to the housing and the ground plate/wire-carrying subassembly being assembled to the housing, respectively, with FIG. 15 including a representative RF generator and coil therearound for Curie point heater soldering.
Figure 15:
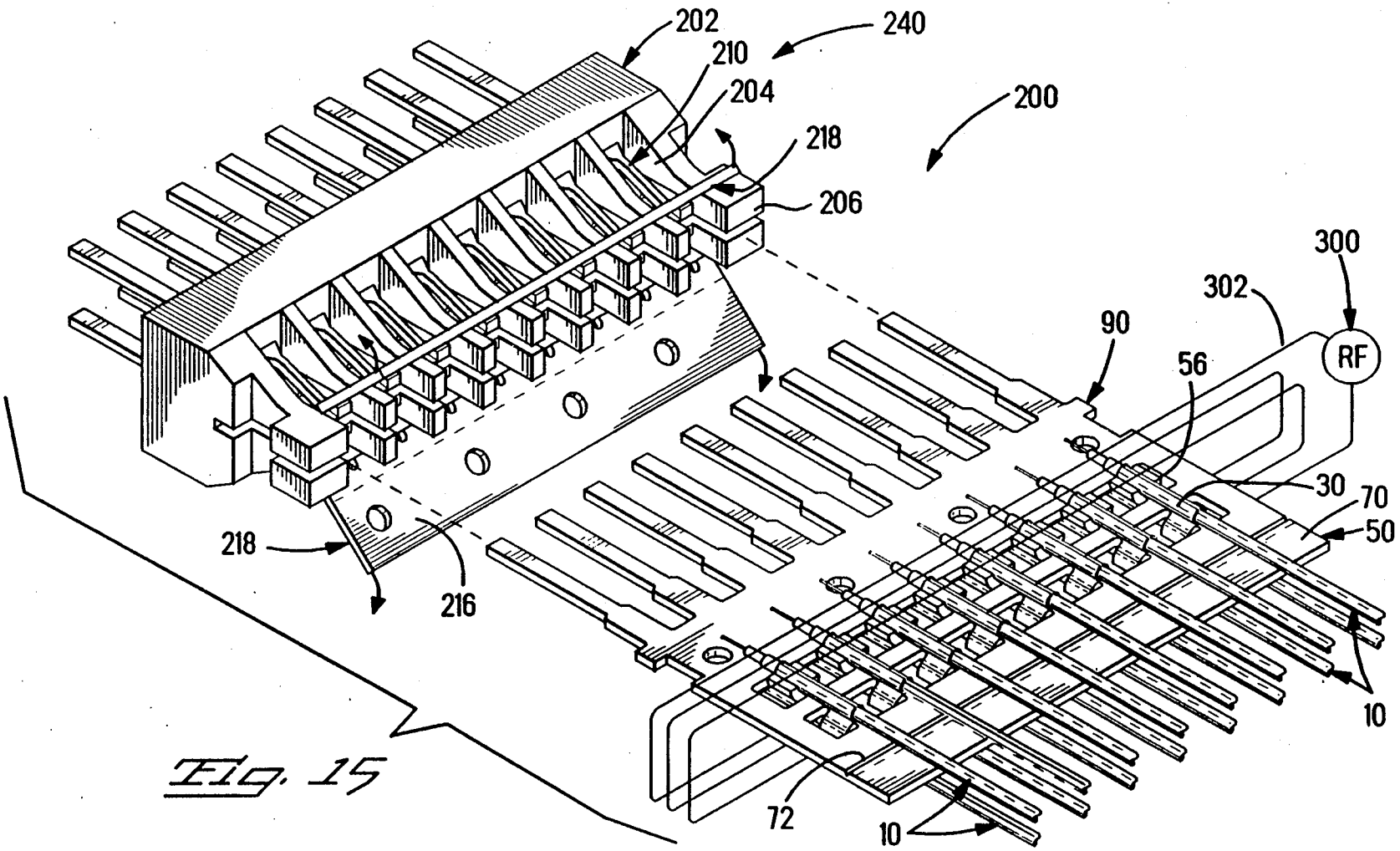

Referring to FIG. 14, signal terminals 210 are maintained initially joined to carrier strips 214 to define lead frames 216 in similar fashion to lead frames 148 of FIG. 7, and carrier strips 214 also preferably include a layer 218 of magnetic material, similar to layer 170 of FIG. 12. Signal terminals may also have contact sections 220 similar to contact sections 142 of FIG. 7 which enter channels 204 of rearward section 206 of housing 202 during assembly and are insertable into passageways 208. Each signal terminal 210 includes a body section 222 insertable into a respective passageway 208 and is retained therein in interference fit, forming a connector subassembly 240 (FIG. 15). Tapered rear edges 224 of body sections 222 provide push surfaces engageable by tooling (not shown) for mounting of connector 200 to a printed circuit board.

Intermediate section 226 of each terminal 210 extends from body section 222 and has a much reduced width, extending to substantially angled bend 228 and rear section 230 joining signal terminal 210 to carrier strip 214 at frangible section 232 which facilitates carrier strip removal after completion of soldering.

Assembly of wire-carrying subassembly 90 to connector subassembly 240 is illustrated in FIG. 15. Wire-carrying subassembly 90 is formed by soldering ferrules 30 in nests 56 using RF apparatus 300 and coil 302 to cause the Curie point heater section 70 of ground plate 50 to generate thermal energy to reflow the solder deposited along ferrules 30 in nests 56. Carrier strips 214 of lead frames 216 being pried slightly apart to lift intermediate sections 226 of signal terminals 210 away from the housing to permit inner conductor portions 20 to be inserted therebetween.

Figure 17:
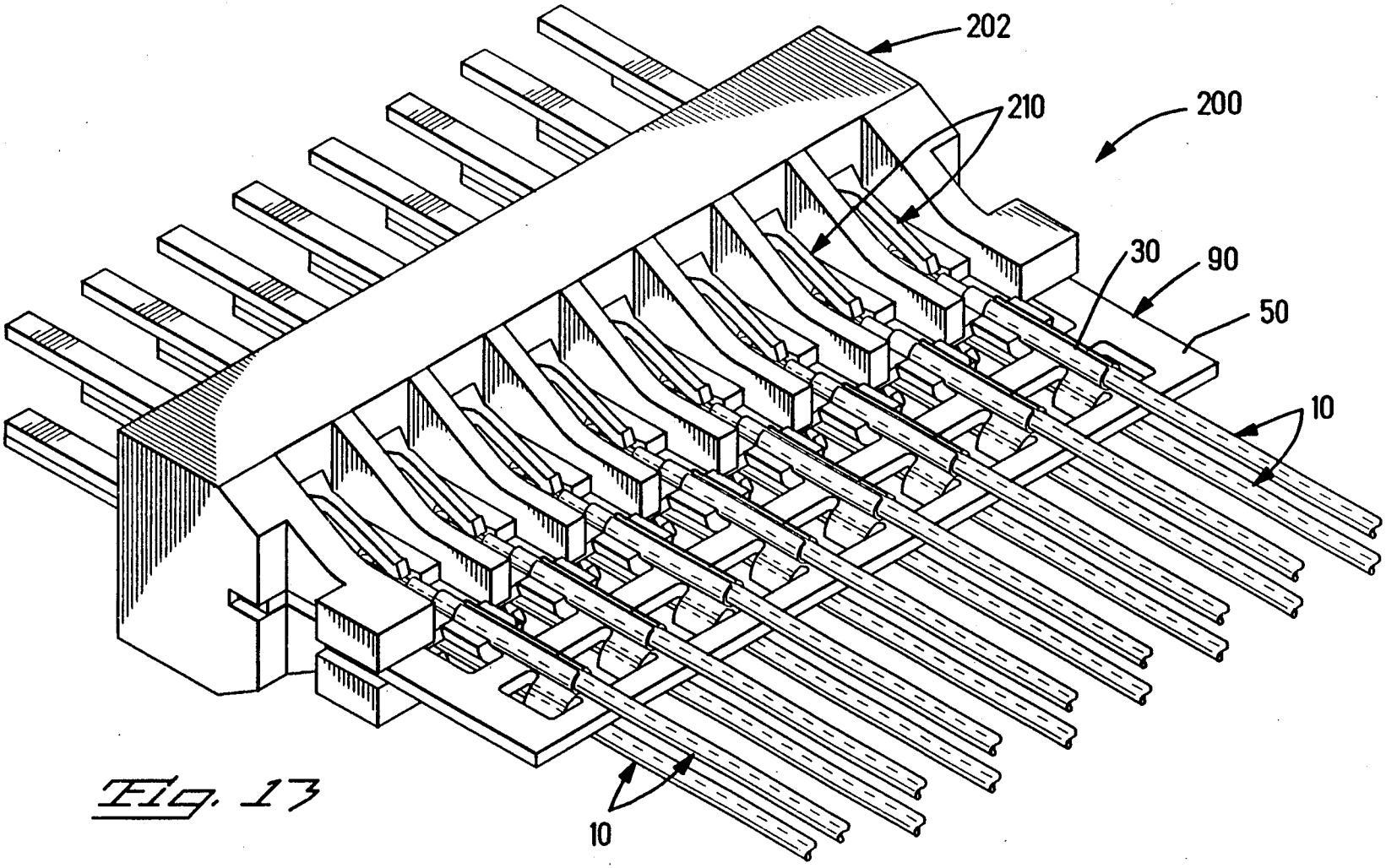
FIGS. 16 and 17 are longitudinal section and enlarged sectional views of the signal termination region of the connector of FIGS. 13 to 15, with FIG. 16 including a representative RF generator and coil therearound for Curie point heater soldering.
Figure 16:
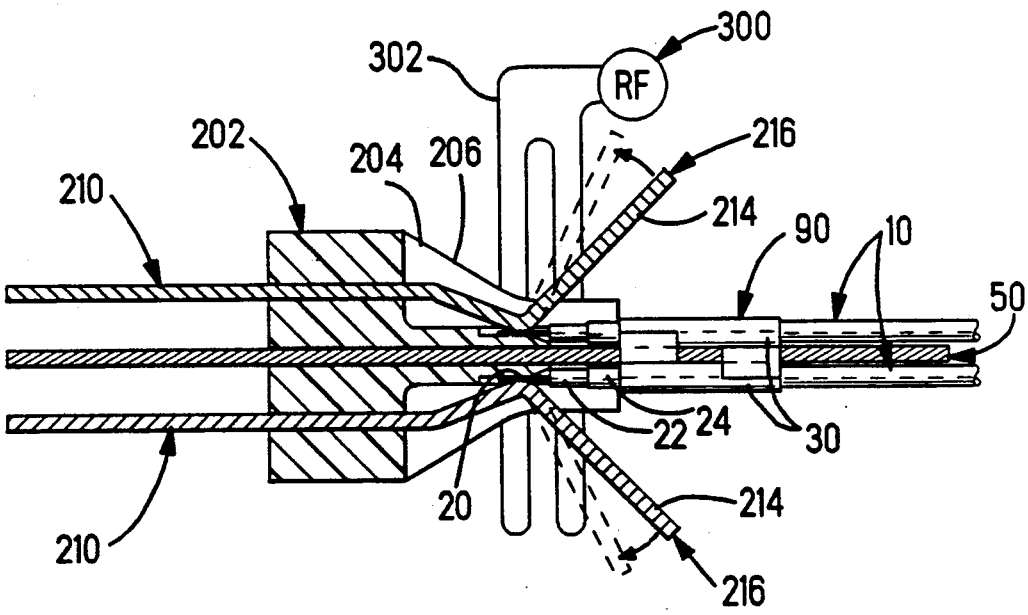
Figure 17:
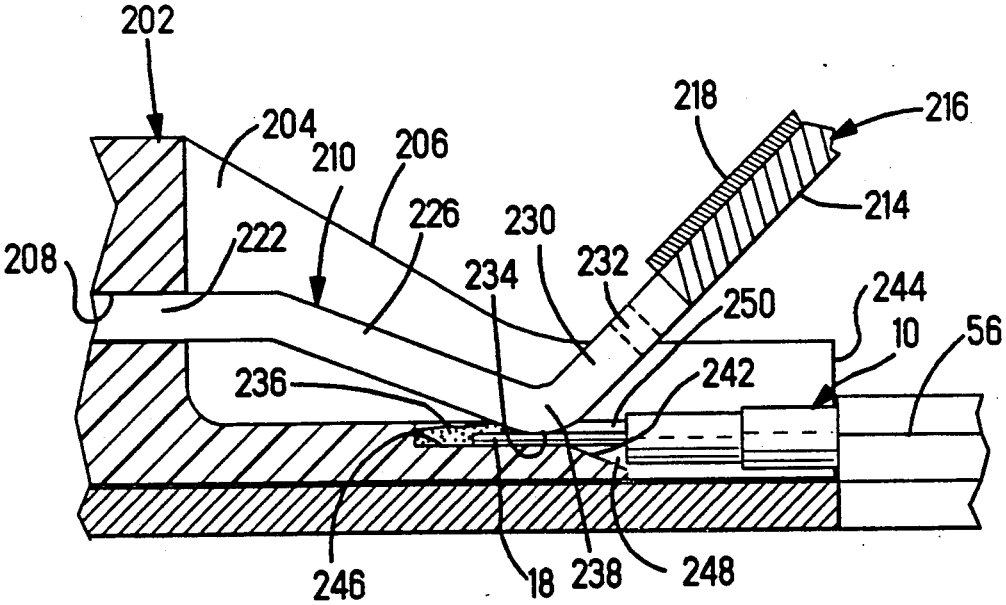

In FIGS. 16 and 17, inner conductor portions 20 are seen to enter narrow channel portions 242 at rearward end 244 of housing 202 within channels 204, with intermediate terminal sections 226 temporarily raised so that wire-engaging surfaces 234 are spaced from bottom surfaces 246 of narrow channel portions 242. Chamfered surfaces 248 assure against snagging or stubbing of the ends of inner conductors 18, while converging sidewalls 250 of narrow channel portions 242 center the inner conductor directly beneath the wire-engaging surface 234 of the corresponding signal terminal 210. Carrier strips 214 are then released and intermediate terminal sections 226 resile resulting in wire-engaging surfaces 234 at bends 228 engage and slightly compress against inner conductor portions 20. Solder paste 236 is deposited (either before or after placement of inner conductor portions in narrow channel portions 242), and the assembly of connector subassembly/wire-carrying subassembly 240,90 is placed within coil 302 of RF generating apparatus 300. Radiofrequency current is generated inducing the Curie point heater of carrier strip 214 to generate thermal energy which reflows solder 236 and forms a solder joint between inner conductor 18 and its corresponding signal terminal 210. Carrier strips 214 are then removed to define discrete circuits.

It can be discerned that connector assemblies 100,200 of the present invention facilitate assembly and soldering of very small stranded inner conductors of 42 gage microcoaxial wires, especially in conjunction with the ground plate of the present invention which serves as a wire organizer and facilitates soldering of the outer conductor or server shields of the wires. There may occur variations and modifications to the specific embodiments disclosed herein which are within the spirit of the invention and the scope of the claims.

What is claimed is:

1. An electrical connector for use with a plurality of coaxial wires, comprising:

a housing member having a plurality of passageways extending therethrough from a rearward face to a mating face;

a plurality of signal terminals associated with inner conductors of said coaxial wires and insertable into respective said passageways of said housing from said rearward face thereof for contact sections at forward ends thereof to become at least exposed along said housing mating face for electrical connection to another electrical article, said signal terminals arranged in rows and the signal terminals of each said row being initially joined to a carrier strip at rear ends thereof; and a ground plate including contact sections extending forwardly from a body section thereof for insertion into respective passageways of said housing member to become at least exposed along said housing mating face for electrical connection to said another electrical article, said ground plate including a rear section extending rearwardly from said body section and including ground termination regions along upper and lower surfaces thereof to which outer conductors of said coaxial wires are electrically joined;

each said signal terminal including a rear section extending outwardly from a medial plane of said housing to a said carrier strip from a substantial bend adjacent said housing for termination to a respective said inner conductor just forwardly of said bend; and said housing having a rearward section including a plurality of channels along opposed surfaces thereof adapted to receive intermediate sections of said signal terminals therealong, and concluding in narrowed channel portions extending to respective wire-receiving entrances at a rearward end of said housing adapted to receive thereinto respective said inner conductors of said coaxial wires being moved axially forwardly of said substantial bends and into termination sites for solder termination to respective said signal terminals, whereafter said carrier strips are removable to define discrete circuits of said signal terminals to respective said inner conductors of said coaxial wires.

2. The connector assembly as set forth in claim 1 wherein each said carrier strip includes a first layer of a first metal having low magnetic permeability and low electrical resistance, and a second layer intimately joined to said first layer of a second metal having high magnetic permeability and high electrical resistance and having a thickness of about 0.0007 to about 0.0010 inches.

3. The connector assembly as set forth in claim 1 wherein said signal terminals are joined to said carrier strips at frangible sections, whereby said carrier strips are adapted to be broken from said signal terminals following soldering.

4. The connector assembly as set forth in claim 3 wherein each said carrier strip includes a first layer of a first metal having low magnetic permeability and low electrical resistance, and a second layer intimately joined to said first layer of a second metal having high magnetic permeability and high electrical resistance and having a thickness of about 0.0007 to about 0.0010 inches.

5. The connector assembly as set forth in claim 1 wherein said rear section of each said signal terminal extends from said bend substantially transversely of said intermediate section and includes an aperture therethrough defining a wire-receiving opening for insertion therethrough of a stripped end of a said inner conductor to coextend along an outwardly facing surface of said intermediate section forwardly of said bend defining a termination site visible and accessible from outwardly of said housing.

6. The connector assembly as set forth in claim 5 wherein said outwardly facing surface of said intermediate section includes a groove therealong extending forwardly from an entrance at said bend adapted to receive said stripped inner conductor end thereinto upon insertion through said aperture, for soldering.

7. The connector assembly as set forth in claim 6 wherein said channel of said housing includes side walls and a bottom surface shaped and dimensioned to guide said stripped inner conductor end to said aperture and said groove entrance without snagging and stubbing.

8. The connector assembly as set forth in claim 1 wherein said rear section of each said signal terminal extends from said bend substantially transversely of said intermediate section, and said intermediate section has a width substantially less than that of said body section to define a flexible section enabling deflection of said carrier strip outwardly of said housing to flex said intermediate section away from an opposing bottom surface of a respective said housing channel to permit receipt of a stripped conductor end between an inwardly facing surface of said intermediate section forwardly of said bend and said bottom channel surface, defining a termination site, whereafter said intermediate section resiles to press said stripped inner conductor end against said bottom channel surface prior to soldering.

9. The connector assembly as set forth in claim 8 wherein said narrowed channel portion is shaped and dimensioned to guide said stripped inner conductor end to be disposed beneath said deflected intermediate section.

10. The connector assembly as set forth in claim 8 wherein a frangible section joins said rear section each said signal terminal to a said carrier strip whereby said carrier strip is adapted to be broken from said signal terminals following soldering.

11. An improved ground plate for providing for termination to outer conductors of coaxial wires and for insertion into a medial plate receiving slot of a connector housing between rows of signal terminals terminated to inner conductors of the coaxial wires and further having ground contact sections extending forwardly of a mating face of the connector housing between rows of contact sections of said signal terminals for impedance matching, the improvement comprising said ground plate including a rearward portion extending in a plane rearwardly of said housing including a termination region having an array of nests stamped and formed to extend outwardly of said plane in at least one direction to receive thereinto portions of respective said coaxial wires spaced rearwardly of forward ends thereof for exposed outer conductor portions to be soldered within and to said nests during initial connector assembly procedures, defining a ground termination and a wire-carrying subassembly for manipulation of ends of said wires as a unit for further connector assembly procedures.

12. The improved ground plate as set forth in claim 11 wherein each said nest includes arcuate wall portions formed outwardly of said plane together defining a semicylindrical shape approximating the diameter of said portion of a said coaxial wire.

13. The improved ground plate as set forth in claim 11 wherein each said nest includes arcuate wall portions formed outwardly of said plane together defining a semicylindrical shape approximating the diameter of a ferrule member crimped to and around said portion of a said coaxial wire.

14. The improved ground plate as set forth in claim 11 wherein forward edges of forwardmost ones of said nests are axially positioned to define a stop surface for stopping axially forward movement of said wire-carrying subassembly into said medial plate-receiving slot upon abutment with a rearwardly facing surface of said housing, positioning said forward ends of said coaxial wires with respect to said housing when said portions of said coaxial wires are soldered to said ground plate in said nests with reference to said forward edges of said torwardmost ones thereof.

15. The improved ground plate as set forth in claim 11 wherein said ground plate includes a rearwardmost end portion joined to said rearward portion at a frangible section located rearwardly of said termination region, facilitating removal of said rear portion after soldering of said outer conductor portions to said ground plate in respective said nests, said rearwardmost end portion including a first layer of a first metal having low magnetic permeability and low electrical resistance, and a second layer intimately joined to said first layer of a second metal having high magnetic permeability and high electrical resistance and having a thickness of about 0.0007 to about 0.0010 inches.

16. The improved ground plate as set forth in claim 11 wherein said nests are formed outwardly of both major surfaces of said rearward portion of said ground plate for said coaxial wires to be soldered along both said major surfaces thereof.

17. The improved ground plate as set forth in claim 16 wherein said nests extending from one of said major surfaces are arrayed in a row axially staggered with respect to others of said nests extending from the other of said major surfaces also arrayed in a row.

18. A method of terminating outer conductors of an array of discrete coaxial wires to a ground plate of an electrical connector disposed within a housing of the connector, comprising the steps of:

providing a ground plate having at least one ground contact section extending forwardly of a body section to extend forwardly of a mating face of said connector housing and having a planar rearward section;

forming nests associated with respective ones of said coaxial wires to extend outwardly of at least one major surface of said planar rearward section, each said nest being shaped and dimensioned to receive thereinto and axially therealong a portion of a respective said coaxial wire having an outer conductor portion at least extending along said wire portion;

preparing said coaxial wires for said portion to be received into a respective said nest to have an exposed conductive outer surface at least electrically joined to said outer conductor thereof; and soldering said exposed conductive outer surface of each said coaxial wire to and within a respective said nest, whereby a wire-carrying subassembly is defined of said ground plate and ends of said coaxial wires manipulatable as a unit, and defining a ground path of said outer conductors of said coaxial wires to at least one ground contact section at least exposed along the connector mating face.

19. The method as set forth in claim 18 further including the step of inserting said wire-carrying subassembly into a plate-receiving slot of said connector housing with said at least one ground contact section extending into and through a corresponding passageway of said housing and forwardly of said mating face of said housing.

20. The method as set forth in claim 18 wherein conductive ferrules are affixed to said wire portions in grounding engagement with respective said outer conductors prior to assembly of said coaxial wires to said ground plate.

21. The method as set forth in claim 20 further ferrules are of a selected length and transverse edges thereof, and said positioning step includes positioning said wire portions into respective said nests with reference between said transverse edges of said ferrules and transverse edges of said nests, for stripped inner conductor end portions of said wires to be axially positioned at appropriate locations with respect to signal terminals of said connector upon assembling of said wire-carrying subassembly into said housing.

22. The method as set forth in claim 21 further including after said soldering step the step of stripping portions of selected lengths of an outer jacket and said outer conductor forwardly of a respective said nest and portions of a selected length of an inner insulation to define a stripped inner conductor end portion, all with axial reference to a said transverse edge of said nest.

* * * * *